US006957618B1

(12) United States Patent
Holder

(10) Patent No.: US 6,957,618 B1
(45) Date of Patent: Oct. 25, 2005

(54) HONEYCOMB SHAPED SPOOL HOLDER FOR SEWING MACHINES

(76) Inventor: Jamesetta Holder, 3868 Louisiana St., Gary, IN (US) 46409

( * ) Notice: Subject to any disclaimer, the term of this patent is extended or adjusted under 35 U.S.C. 154(b) by 0 days.

(21) Appl. No.: 10/909,586

(22) Filed: Aug. 2, 2004

(51) Int. Cl.[7] ..... D05B 43/00
(52) U.S. Cl. ..... 112/302
(58) Field of Search ..... 112/302, 258, 254, 112/278, 279; 242/118.1, 129.1, 129.71, 242/130; D15/72, 78; 223/106

(56) References Cited

U.S. PATENT DOCUMENTS

| | | | | |
|---|---|---|---|---|
| 218,428 A | | 8/1879 | Carroll | |
| 416,292 A | | 12/1889 | Fowler | |
| 458,431 A | | 8/1891 | Sidebottom | |
| 924,891 A | | 6/1909 | Curfew et al. | |
| 2,069,944 A | | 2/1937 | Dunlap | |
| 3,561,698 A | | 2/1971 | Steffenini | |
| 3,658,275 A | * | 4/1972 | Lahmann | 242/118.4 |
| 3,738,590 A | * | 6/1973 | Granati | 242/130 |
| 3,856,229 A | | 12/1974 | Buram | |
| 4,106,723 A | * | 8/1978 | Couture | 242/118.3 |
| D250,338 S | * | 11/1978 | LaPierre | D15/78 |
| 4,254,917 A | | 3/1981 | Okamura et al. | |
| 4,667,896 A | | 5/1987 | Frey et al. | |
| 5,211,353 A | * | 5/1993 | Lewin et al. | 242/118.41 |
| 5,513,820 A | | 5/1996 | Meyer | |
| 5,626,302 A | | 5/1997 | Hrobar | |
| 5,694,873 A | | 12/1997 | Wu | |
| 6,328,254 B1 | | 12/2001 | Holder | |

FOREIGN PATENT DOCUMENTS

WO 91/01/262 WO 2/1991

* cited by examiner

*Primary Examiner*—Ismael Izaguirre

(57) ABSTRACT

A spool holder for a sewing machine, which holder finds particular use in a serger-style sewing machine, nests in the core of a thread spool and is matable with a spindle to generally maintain the thread spool in a stationary position for unwinding of the thread wound on the spool during a sewing operation, which spool holder may rotate on the spindle from the application of undue forces but is stable and strong enough to provide stability to the thread spool and its core.

8 Claims, 3 Drawing Sheets

HONEYCOMB SHAPED SPOOL HOLDER FOR SEWING MACHINES

BACKGROUND OF THE INVENTION

The present invention relates to a spool holder for sewing machines. More particularly, the invention relates to a honeycomb-shaped spool-holder for holding a cone-shaped thread holder on a spindle of a serger-style sewing machine.

A variety of thread holders have been disclosed for use with sewing machines. The thread is commonly wound around a cone-shaped or cylindrical spool or core. A spool holder is generally inserted into the base of a thread holder or core prior to mounting on a sewing machine spindle for unwinding of the thread. A common thread bobbin and mated spool holder, which are mounted on a sewing machine spindle, will typically rotate and wobble as the thread is dispensed from the spool and bobbin with the spool holder rotating at a high angular velocity.

Some of these thread holders and spool holders have been specifically designed for use on serger-style sewing machine with the thread commonly wound around a cone-shaped spool. A spool holder is generally inserted in the base of the cone-shaped spool prior to mounting the mated pair onto a sewing machine spindle. During operation of the sewing machine, the mated spool holder and thread holder tend to jump and wobble as the thread unravels from the cone-shaped spool. In a serger-style sewing machine, the thread is typically unwound from the spool, and it is very desirable to maintain the cone-shaped spool holder in a stationary position to allow the thread to unwind from the spool as smoothly as possible rather than to allow the thread spool to rotate.

Preexisting spool holders for serger-style sewing machines suffer from various disadvantages, as they are generally of a weak construction and, easily crack or break during usage. Therefore, it is highly desirable to have an improved and durable spool holder capable of withstanding a wide range of dynamic forces, which may be experienced during a sewing operation. The present invention addresses this problem by providing a honeycomb-shaped spool-holder having an inner cylindrical hub, an outer conical member, and a plurality of partition walls extending in an axial direction therebetween in such manner as to sufficiently reinforce its overall structure to resist breakage during normal operations.

Further, the above-noted prior art spool holders may be suitable for a particular purpose, but they have not been found to have the strength and durability of the spool-holder of the present invention, and they have not been found to have the capability to maintain the spool in a relatively stable and stationary position on the spindle of a serger-style sewing machine.

SUMMARY OF THE INVENTION

A honeycomb-shaped spool-holder of relatively simple construction minimizes manufacturing costs, provides strength and durability, and provides relative stability to the retained thread-spool core, and thus to the thread wound thereon for ease of unraveling during sewing machine operation.

The invention has a honeycomb-shaped spool-holder with an inner cylindrical hub, an outer conical member, and a plurality of partition walls axially extending between the cylindrical hub and outer conical member. The partition walls reinforce the spool-holder structure to resist breakage of a spool holder during normal operations of a sewing machine, which spool holder has been mated with a thread-spool core.

The truncated conical or cylindrical exterior configuration of the spool-holder is provided in a size and shape to frictionally engage the interior surfaces of a cone-shaped thread-spool core.

The present invention is a honeycomb-shaped spool-holder for use with sewing machines, and more particularly with serger-style sewing machines. The serger-style sewing machines have at least one upstanding spool support spindle, and may have a plurality of support spindles. The honeycomb-shaped spool-holder has an inner cylindrical hub with a central bore extending therethrough for vertically receiving the spindle of a sewing machine. The spool-holder may freely rotate about the spindle as the thread unravels from the spool, although the thread generally unravels with minimal or no rotational movement of either the spool-holder or spool-thread core about the spindle. The spool-holder outer member has a truncated conical configuration, which is sized and shaped to frictionally engage the interior surfaces of a cone-shaped spool-core. As noted above, a plurality of partition walls extend in an axial direction between the inner hub and the outer member such that a spoke or honeycomb pattern is formed between the hub and the outer wall. The partition walls strengthen the structure of the spool holder to withstand a wide range of dynamic forces experienced by the spool-holder and thread-holding core, which dynamic forces result from thread being unwound from the thread-holding core. In addition, strains may be experienced by the spool-holder and the affixed core from occasional and inadvertent rotation of these components about the spindle when the aforementioned dynamic forces are great enough to rotate the mated spool-holder and core.

To the accomplishment of the above and related objects, the invention may be embodied in the form illustrated in the accompanying drawings. The drawings are merely illustrative and not a limitation. Variations of the invention structure are contemplated as being part of the invention, limited only by the scope of the claims.

BRIEF DESCRIPTION OF THE DRAWING

In the drawing, like reference numerals refer to like elements. The drawings are briefly described as follows.

DETAILED DESCRIPTION OF THE PREFERRED EMBODIMENT

Figure 1:
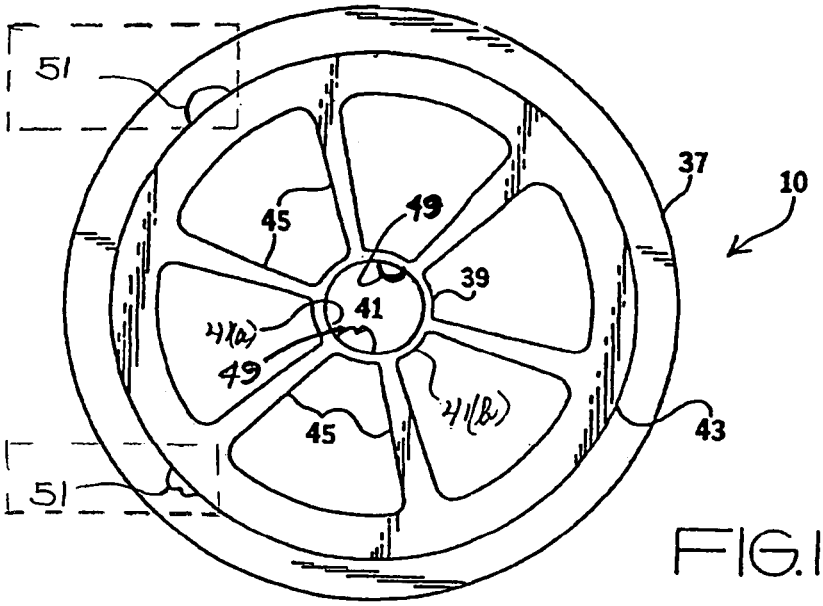
FIG. 1 is a diagrammatic perspective view of a preferred embodiment of a honeycomb-shaped spool holder of the present invention.
Figure 2:
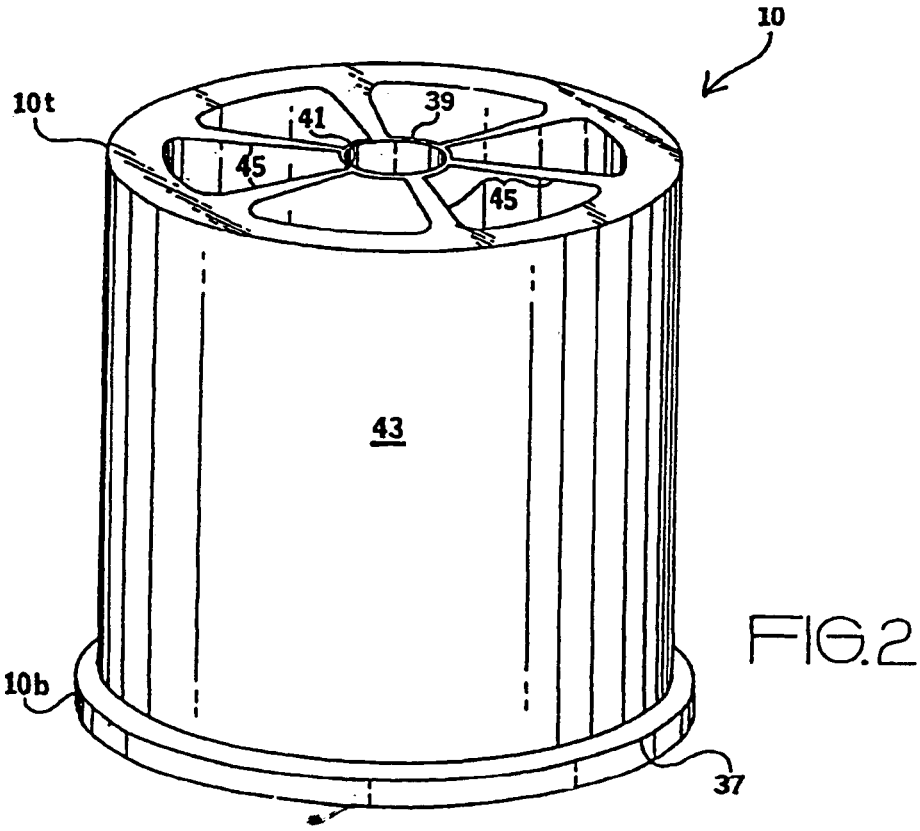
FIG. 2 is a top plan view of the honeycomb-shaped spool-holder.
Figure 3:
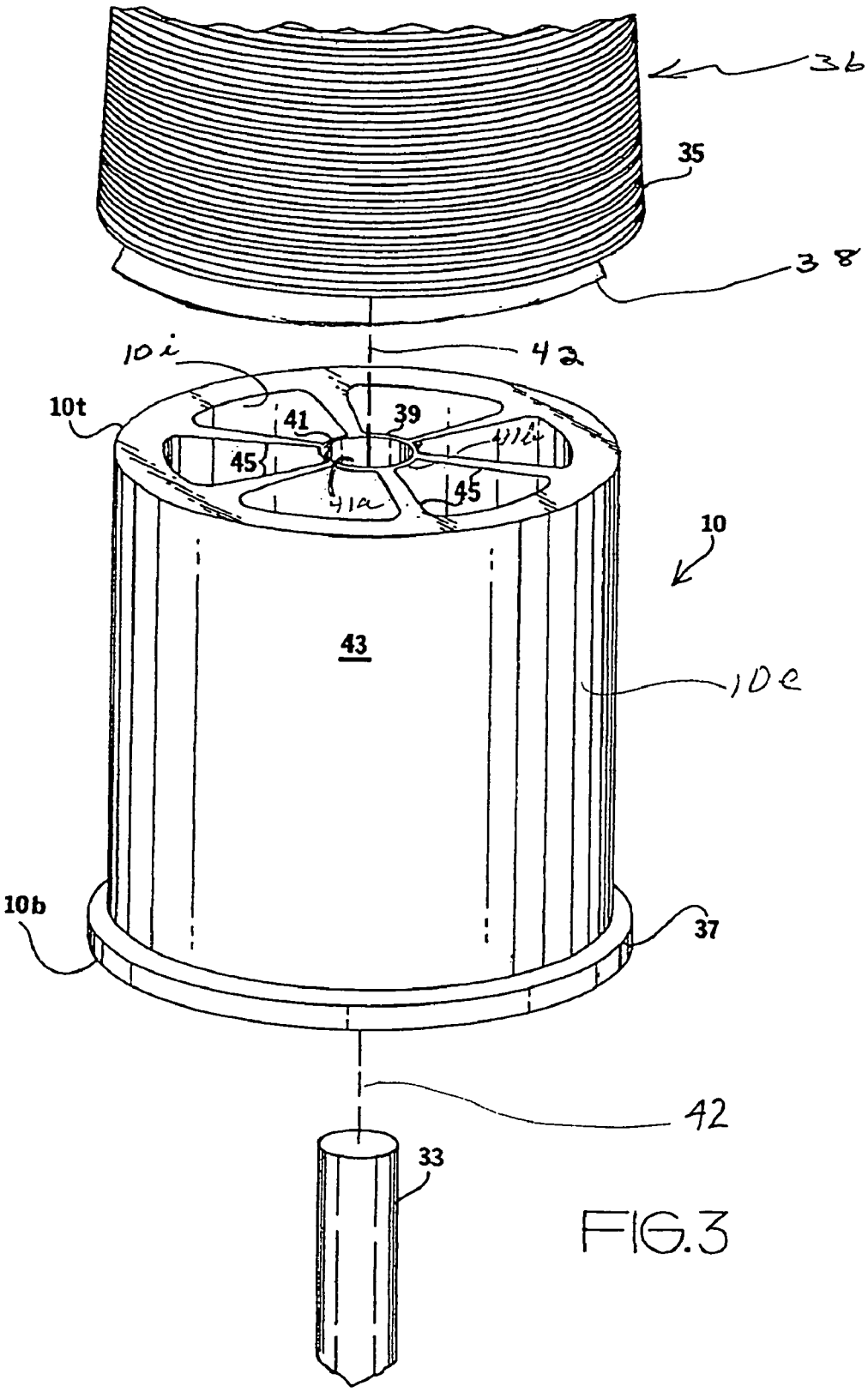
FIG. 3 is an exploded view of the present honeycomb-shaped spool-holder, a cone-shaped thread holder, and an upstanding spool support spindle.
Figure 4:
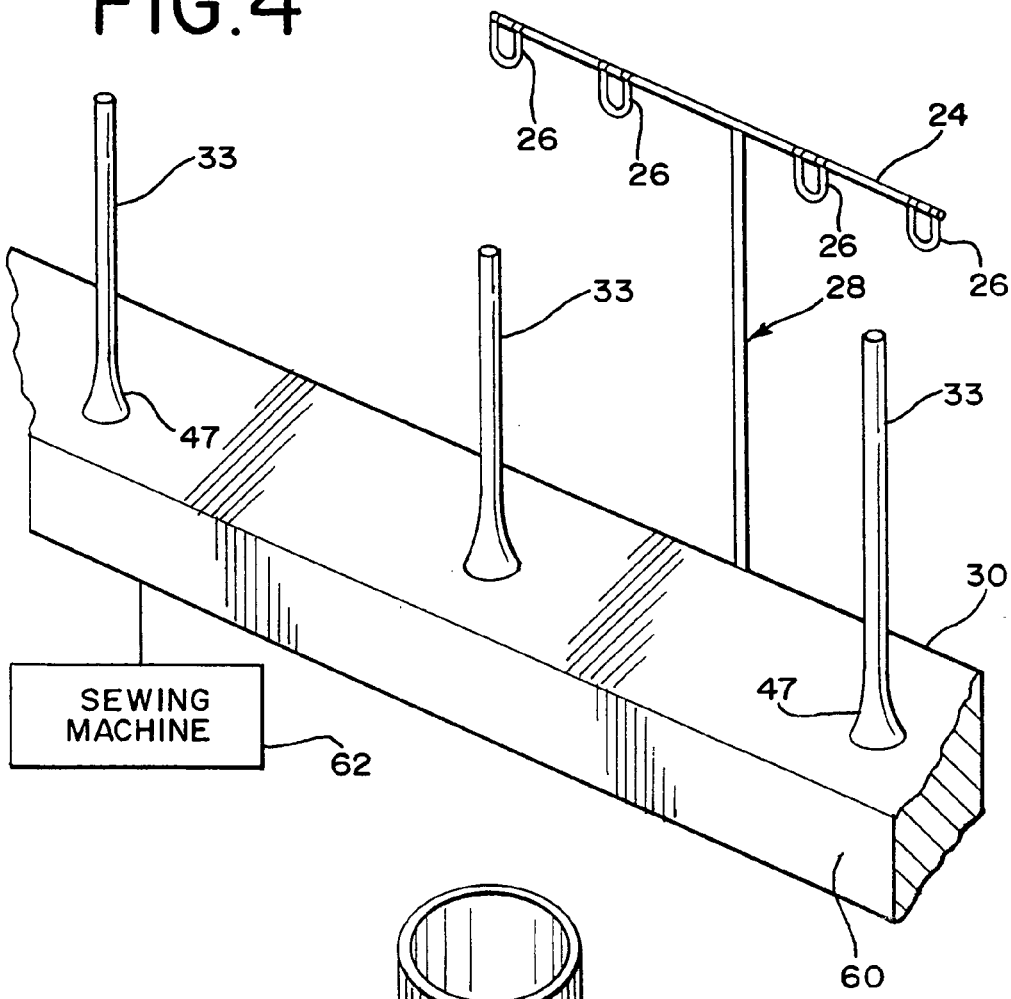
FIG. 4 illustrates a plurality of upright spindles on a base with a thread guide tree.
Figure 5:
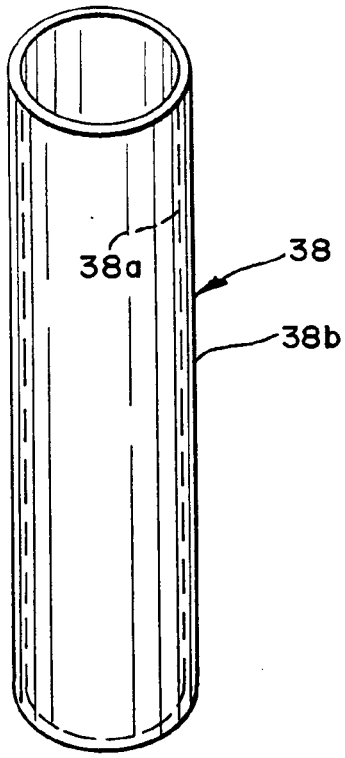
FIG. 5 shows an upright spool-thread core.

FIGS. 1 and 2 illustrate a preferred embodiment of honeycomb-shaped spool holder or means for holding 10 in accordance with the teaching of the present invention. An upstanding spool support spindle 33 is illustrated in FIG. 3, which spindle 33 holds spool holder 10 and sewing thread spool cores 38 extending upward from base plate 30 of spindle holder 60 noted in FIG. 5. Base plate 30 of spindle holder 60 includes a plurality of spindles 33 and thread guide tree 28 having several thread guides 26 attached to crossarm 24, which guides 26 receive therethrough thread 35 from thread spool 36 for use in a sewing operation. Spool holder 10 holds thread spool 36, which has cone-shaped spool core 38 with conventional sewing threads 35 wound thereon.

In FIGS. 1 and 2, spool holder 10 has outer member 43, which has an overall truncated conical shape configured for frictionally engaging interior surface 38*a* of cone shaped spool core 38. Honeycomb shaped spool holder 10 has bottom end 10*b* and top end 10*t*, where the diameter of top end 10*t* may be smaller than the diameter of bottom end 10*b*, which creates a tapered and truncated conical exterior configuration. It is not requisite that top end 10*t* be smaller than bottom end 10*b*, which would make spool holder 10 generally cylindrical. Flange 37 extends radially from bottom end 10*b* of spool holder 10 to retain thread-spool core 38 with sewing thread 35 against downward movement on spool holder 10.

Spool holder 10 includes inner cylindrical hub 39 with central bore 41 extending there through for vertically receiving spindle 33 of a sewing machine. In a preferred embodiment, central bore 41 of spool holder 10 has central longitudinal axis 42 and is sized to allow holder 10 to engage or mate with spindle 33, which restricts or inhibits rotation of spool holder 10 and cone-shaped spool core 38 as thread 35 is unraveled and dispensed from spool core 38. Alternatively, interior surface 41*a* of hub 39, which is shown as a cylinder, may be tapered from bottom end 10*b* to top end 10*t* to frictionally secure spool holder 10 on spindle 33. The noted taper in central bore 41 would be wider at bottom end 10*b* and more narrow at top end 10*t* but the taper should be adequate to initially receive spindle 33 at least one-half the length between bottom end 10*b* and top end 10*t*. The precise mechanism inhibiting the rotation of spool holder 10 and core 38 is not asserted, but may be due to the weight of thread spool 36, frictional engagement between spool holder 10 and spindle 33, the resistance between similar materials or any other mechanism.

A plurality of partition walls 45 extends in an axial direction between inner hub 39 and outer member 43 such that a honeycomb or spoke pattern is formed as shown in FIG. 2. Partition walls 45 help to sufficiently strengthen spool holder 10 to resist a wide range of dynamic forces. These dynamic forces may be applied while spool holder 10 is constrained against rotation about spindle 33, as thread 35 is unraveled or unwound from spool core 38. If slippage of core 38 on spool holder 10 occurs, or if the mated core 38 and spool holder 10 slip on spindle 33 during unraveling of thread 35 from core 38, spool holder 10 is adequately strengthened to allow rotation of either spool holder 10 or core 38 thereon. Spool holder 10 may be constructed of any suitable lightweight and durable material, such as plastic, nylon, rubber, which specific requisite grade of such materials may be selected based upon their specified characteristics noted by the manufacturer.

Honeycomb shaped spool holder 10 is vertically mounted on a sewing machine by extending an upstanding spool support post or spindle 33 through central bore 41 of spool holder 10. A cone-shaped thread holder 38 with thread 35 wound thereon is placed over spool holder to, which is mounted about upstanding support post 33. Cone-shaped holder 38 with thread 35 and honeycomb-shaped spool holder 10 are mated with and retained on spindle 33 while thread is unraveled from cone-shaped core 38. Although central bore 41 snugly engages spindle 33 in the normal operating mode, it is known that undue forces may be imposed on thread 35, and thus cone holder 38, during operation of sewing machine 62 and the unraveling of thread 35. Therefore, holder 10 may slip whenever rotational forces above the usual operating mode are imposed on spool holder 10. In addition, spool holder 10 has a very durable construction to avoid breaking or cracking during normal usage. The present structure provides strength to spool holder 10 to resist fracture when excess stresses from thread unwinding induce rotation of spool holder 10 on spindle 33.

In an alternative situation, spindle 33 may have a tapered or arcuate footing 47 to contact central bore 41 at bottom end 10*b*, which may provide added frictional engagement between spool holder 10 and spindle 33. This engagement would provide further resistance to rotational movement of spool holder 10 and cone-shaped core 38. This is not a limitation as to the operation of spool holder 10, as the specific embodiment of the spool holder for a desired application may utilize a frictional engagement between spindle 33 and spool holder hub interior surface 41*a*.

In addition, ridges, nodes or protuberances 49 on interior surface 41*a*, as noted in FIG. 1, may provide a more secure or frictional contact with spindle 33. The added contact between protuberances 49 and spindle 33 would further resist rotation of spool holder 10. The shape of ridges, nodes or protuberances 49 in FIG. 1 is not a limitation, but is illustrative, and these ridges may have any appropriate shape.

Similarly in FIG. 1, ridges, nodes or protuberances 51 may be provided on outer member external surface 10*e* to engage spool core inner surface 38*a* and to retain spool core 38 on holding means 10.

Many specific details contained in the above description merely illustrate preferred embodiments and are not to be construed as a limitation on the scope of the invention. Many other variations are possible.

What is claimed is:

1. In a serger-style sewing maching, means for holding (10) a thread-spool (36) on an upstanding spool support spindle (33) of said serger-style sewing machine, said thread-spool (36) having a hollow core (38) with an inner surface (38*a*) and an outer surface (38*b*) with a thread (35) wound on said outer surface (38*b*), said means for holding (10) comprising:

an outer member (43) having an internal surface (10*i*), an external surface (10*e*), a top end (10*t*) and a bottom end (10*b*), said outer member (43) configured to allow said external surface (10*e*) to mate with said hollow core (38), an inner cylindrical hub (39) having a hub wall (39*a*) and a central longitudinal axis (42), said hub wall (39*a*) having an interior surface (41*a*) and an exterior surface (41*b*) and defining a central bore (41) extending through said hub (39) along longitudinal axis (42), a plurality of partition walls (45) axially extending between said top end (10*t*) and said bottom end (10*b*), which partition walls (45) communicate between said hub exterior surface (41*b*) and said outer member inner surface (10*i*) to generally define a spoke pattern, said spoke pattern coupling said outer member (43) to said inner hub (39);

said central bore (41) extending between said top end (10*t*) and said bottom end (10*b*), said thread-spool core (38) mated with said means for holding (10) to engage said hollow core (38);

said central bore (41) matable with said spindle (33) and operable to maintain said means for holding (10) and said engaged core (38) at a generally nonrotating and stationary position on said spindle (33) during operation of said serger-style sewing machine and unraveling of said thread (35) from said core (38).

2. Means for holding (10) a thread spool (36) on a spindle (33) as claimed in claim 1 further comprising a flange (37), said flange (37) radially extending from said external surface (10*e*) about said bottom end (10*b*) to restrain said thread spool (36) on said means for holding (10).

3. Means for holding (10) a thread spool (36) on a spindle (33) as claimed in claim 1 wherein said outer member external surface (10*e*) is operable to contact said core inner surface (38*a*) to retain said core on said means for holding.

4. Means for holding as claimed in claim 1, wherein said central bore (41) of said hub (39) is sized to frictionally engage said spindle (33) to resist rotation of said holder (10) about said spindle (33) as thread (35) is unraveled from said thread spool (36).

5. Means for holding (10) as claimed in claim 1, wherein said means for holding (10) is constructed of one of a plastic material, nylon and hard rubber.

6. Means for holding (10) as claimed in claim 1, wherein said central bore interior surface (41*a*) is tapered, which taper is broader at said bottom end (10*b*) and more narrow at said top end (10*t*).

7. Means for holding (10) as claimed in claim 1, wherein said central bore interior surface (41*a*) further comprises any of ridges, nodes or protuberances to frictionally engage said spindle (33).

8. Means for holding (10) as claimed in claim 1, wherein said outer member external surface (10*e*) has at least one ridge, node or protuberance to frictionally engage said core inner surface.

* * * * *